US007658295B2

(12) United States Patent
Hoepner et al.

(10) Patent No.: US 7,658,295 B2
(45) Date of Patent: Feb. 9, 2010

(54) CLOSURE WITH DEFLECTABLE FINGER FOR RETENTION OF LID HINGE SHAFT

(75) Inventors: Travis J. Hoepner, Mukwonago, WI (US); James W. Hammond, North Prairie, WI (US); Cori M. Blomdahl, Muskego, WI (US)

(73) Assignee: Seaquist Closure Foreign, Inc., Crystal Lake, IL (US)

( * ) Notice: Subject to any disclaimer, the term of this patent is extended or adjusted under 35 U.S.C. 154(b) by 832 days.

(21) Appl. No.: 11/268,969

(22) Filed: Nov. 8, 2005

(65) Prior Publication Data

US 2007/0102391 A1 May 10, 2007

(51) Int. Cl.
*B65D 43/16* (2006.01)
*B65D 51/18* (2006.01)

(52) U.S. Cl. ..... 215/237; 215/235; 220/254.5; 220/259.1; 220/832; 220/840

(58) Field of Classification Search ..... 220/254.5, 220/259.1, 836, 840, 832, 254.3; 215/224, 215/235, 237
See application file for complete search history.

(56) References Cited

U.S. PATENT DOCUMENTS 2,304,223 A 12/1942 Westrope
2,342,477 A * 2/1944 Magnenat ..... 220/835
2,677,479 A * 5/1954 Kiba ..... 220/840
2,734,222 A * 2/1956 Kiba ..... 220/840
3,365,094 A * 1/1968 Palson ..... 220/840
3,627,160 A 12/1971 Horvath
4,299,241 A 11/1981 Seiller
4,762,246 A 8/1988 Ashley et al.
4,887,747 A * 12/1989 Ostrowsky et al. ..... 222/556
5,305,900 A * 4/1994 Maguire et al. ..... 215/245
5,328,058 A * 7/1994 Leoncavallo et al. ... 222/153.14
5,465,856 A 11/1995 Sheffler
5,489,039 A 2/1996 Brownlie
5,735,419 A 4/1998 Ma
5,829,611 A 11/1998 Beck
5,875,907 A 3/1999 Lay
5,992,681 A * 11/1999 Byrd et al. ..... 220/831
6,105,809 A 8/2000 Yamanaka
6,405,885 B1 6/2002 Elliott
6,644,487 B2 11/2003 Smith et al.
6,918,508 B2 * 7/2005 Hwang ..... 220/826

(Continued)

OTHER PUBLICATIONS

Pending U.S. Appl. No. 10/610,195.

*Primary Examiner*—Anthony Stashick
*Assistant Examiner*—Niki M Eloshway
(74) *Attorney, Agent, or Firm*—Wood, Phillips, Katz, Clark & Mortimer

(57) ABSTRACT

A closure system is provided for a container. The system has a body for extending from the container at the container opening. The body defines a dispensing orifice. A lid is provided for covering the orifice. The body has a bearing member with two spaced-apart walls for defining a channel for receiving a pivot shaft on the lid. At least one deflectable finger projects from one of the body bearing member walls for being temporarily, elastically deflected to accommodate the insertion of the lid pivot shaft into the channel. The finger is resilient, and moves back over the lid pivot shaft to prevent removal of the lid pivot shaft from the channel.

11 Claims, 13 Drawing Sheets

U.S. PATENT DOCUMENTS 7,124,471 B2 * 10/2006 Koessler ..... 16/267
2003/0121189 A1 7/2003 Williams
2003/0230581 A1 12/2003 Wark

* cited by examiner

FIG. 10
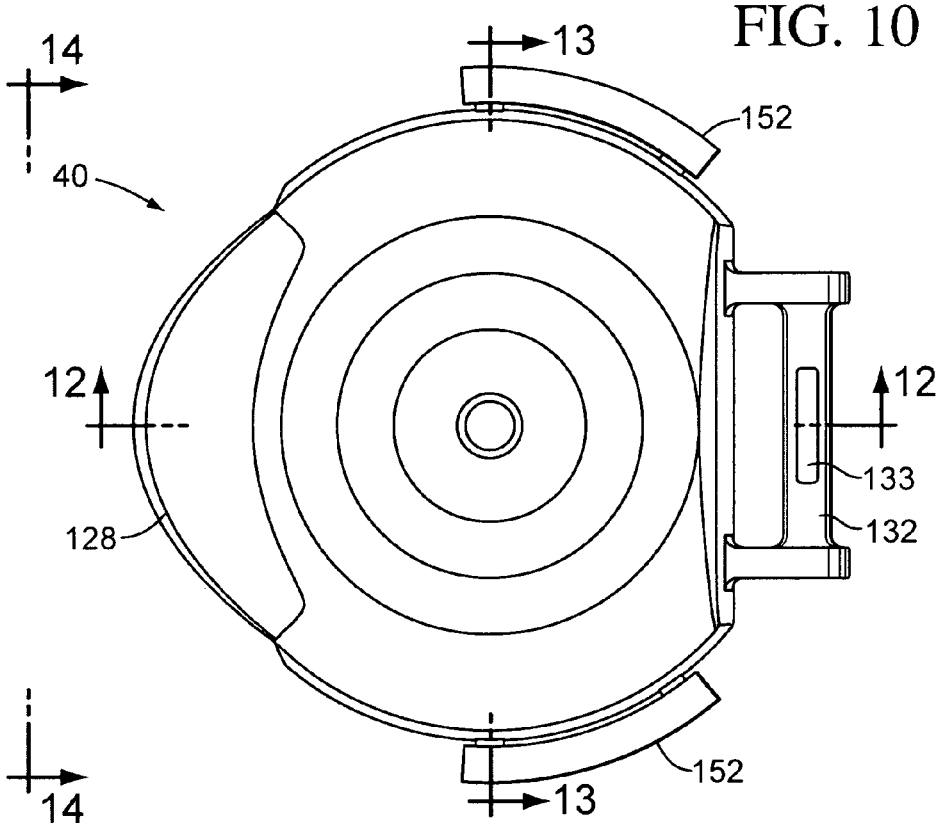
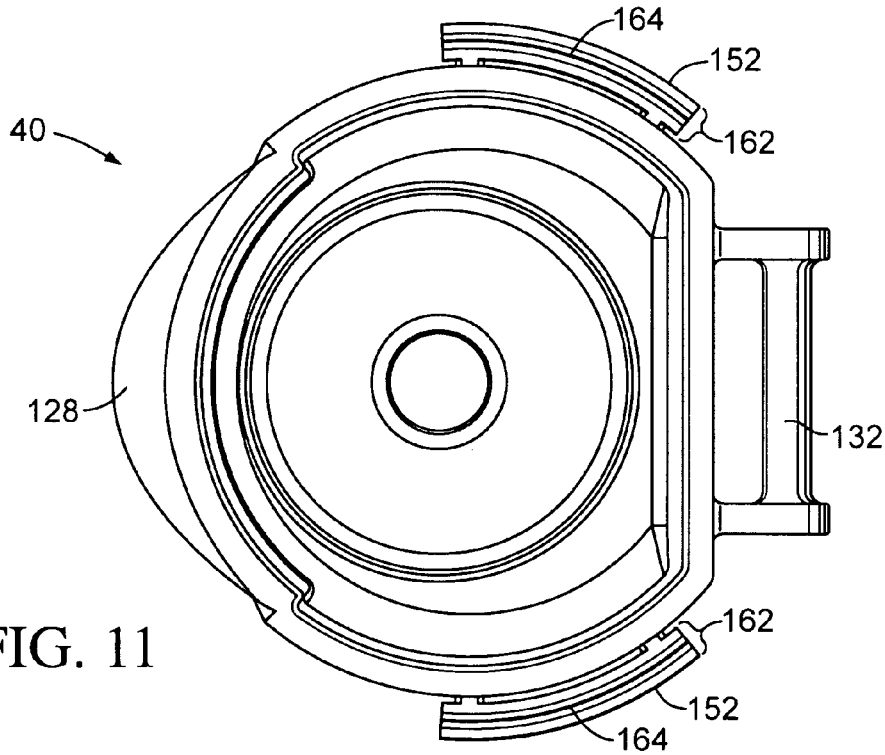
FIG. 11

CLOSURE WITH DEFLECTABLE FINGER FOR RETENTION OF LID HINGE SHAFT

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to closure system for a container. The invention is particularly suitable for incorporation in a dispensing closure for use with a squeezable container.

BACKGROUND OF THE INVENTION AND TECHNICAL PROBLEMS POSED BY THE PRIOR ART

There are a variety of types of conventional closures which function generally satisfactorily in applications for which they are designed. One type of prior art closure includes a body or base for being attached to the top of a container. The body defines a dispensing orifice. The system further includes a lid which is mounted on the base or body and which can be lifted up to open the dispensing orifice. See, for example, U.S. Pat. No. 6,644,487.

The U.S. Pat. No. 6,644,487 discloses the use of a closure having a lid hinge system in which the closure base or body includes a channel for snap-fit retention of a hinge pivot shaft projecting from the rear of the lid. While such a design offers significant advantages, it would be desirable to provide a further improved closure system.

In particular, it would be desirable to provide an improved design in which the lid hinge shaft could be even more securely held on the closure body.

It would also be beneficial if a closure system could readily accommodate molding of the closure body from a thermoplastic material.

It would also be advantageous if such an improved closure system could accommodate bottles, containers, or packages which have a variety of shapes and which are constructed from a variety of materials.

Further, it would be desirable if such an improved system could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The present invention can be incorporated into a closure system that may include one or more of the above-discussed, desired features.

The present invention provides an improved closure system for a container that has an opening to the container interior. The system can be readily operated by the user to open and close the system.

According to a first aspect of a presently preferred embodiment of the invention, unassembled closure system components are provided, and these components include a lid and a body. The body is either a separate structure for attaching to, and extending from, the container at the container opening or is a unitary extension of the container at the opening. The body has (1) at least one orifice for communicating with the container opening, and (2) a bearing member comprising two spaced-apart walls which together define between them a channel, and (3) at least one downwardly extending, laterally deflectable, retention finger projecting from one of the walls over at least a portion of the channel.

The lid is adapted to be disposed on the body for accommodating lifting of the lid relative to the at least one orifice between (1) a closed position over the at least one orifice, and (2) an open position away from the at least one orifice. The lid includes a pivot shaft for being received in the channel by being forced against and past the at least one retention finger which subsequently springs back over at least a portion of the channel to prevent removal of the shaft from the channel.

According to another aspect of the invention, a completed closure system is provided for a container that has an opening to the container interior. The closure system includes a body that is either a separate structure for attaching to, and extending from, the container at the opening or is a unitary extension of the container at the opening. The body has (1) at least one orifice for communicating with the container opening, (2) a bearing member comprising two spaced-apart walls which together define between them a channel, and (3) at least one downwardly extending, laterally deflectable, retention finger projecting from one of the walls over at least a portion of the channel.

A lid is disposed on the body for accommodating lifting of the lid relative to the at least one orifice between (1) a closed position over the at least one orifice, and (2) an open position away from the at least one orifice. The lid includes a pivot shaft disposed in the channel under the at least one retention finger which prevents removal of the shaft from the channel.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 4 shows the closure prior to the closure being installed on the neck of the container, and FIG. 4 further shows the lower tamper-evident band in the as-molded, downwardly depending configuration prior to being turned up under the flange on the container neck;

FIG. 7 shows the closure body prior to being installed on the neck of the container, and FIG. 7 further shows the lower tamper-evident band in the as-molded, downwardly depending configuration prior to being turned up under the flange on the container neck;

FIG. 10 is a top plan view of the closure lid prior to the lid being mounted on the closure body by the manufacturer;

FIG. 11 is a bottom view of the lid prior to the lid being mounted on the closure body by the manufacturer;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a closure system in the typical orientation that it would have at the top of a container when the container is stored upright on its base, and terms such as upper, lower, horizontal, etc., are used with reference to this position. It will be understood, however, that the dispensing closure system of this invention may be manufactured, stored, transported, used, and sold in an orientation other than the position described.

The closure system of this invention is suitable for use with a variety of conventional or special containers having various designs, the details of which, although not illustrated or described, would be apparent to those having skill in the art and an understanding of such containers. The container, per se, described herein forms no part of, and therefore is not intended to limit, the present invention. It will also be understood by those of ordinary skill that novel and non-obvious inventive aspects are embodied in the described exemplary closure systems alone.

Figure 1:
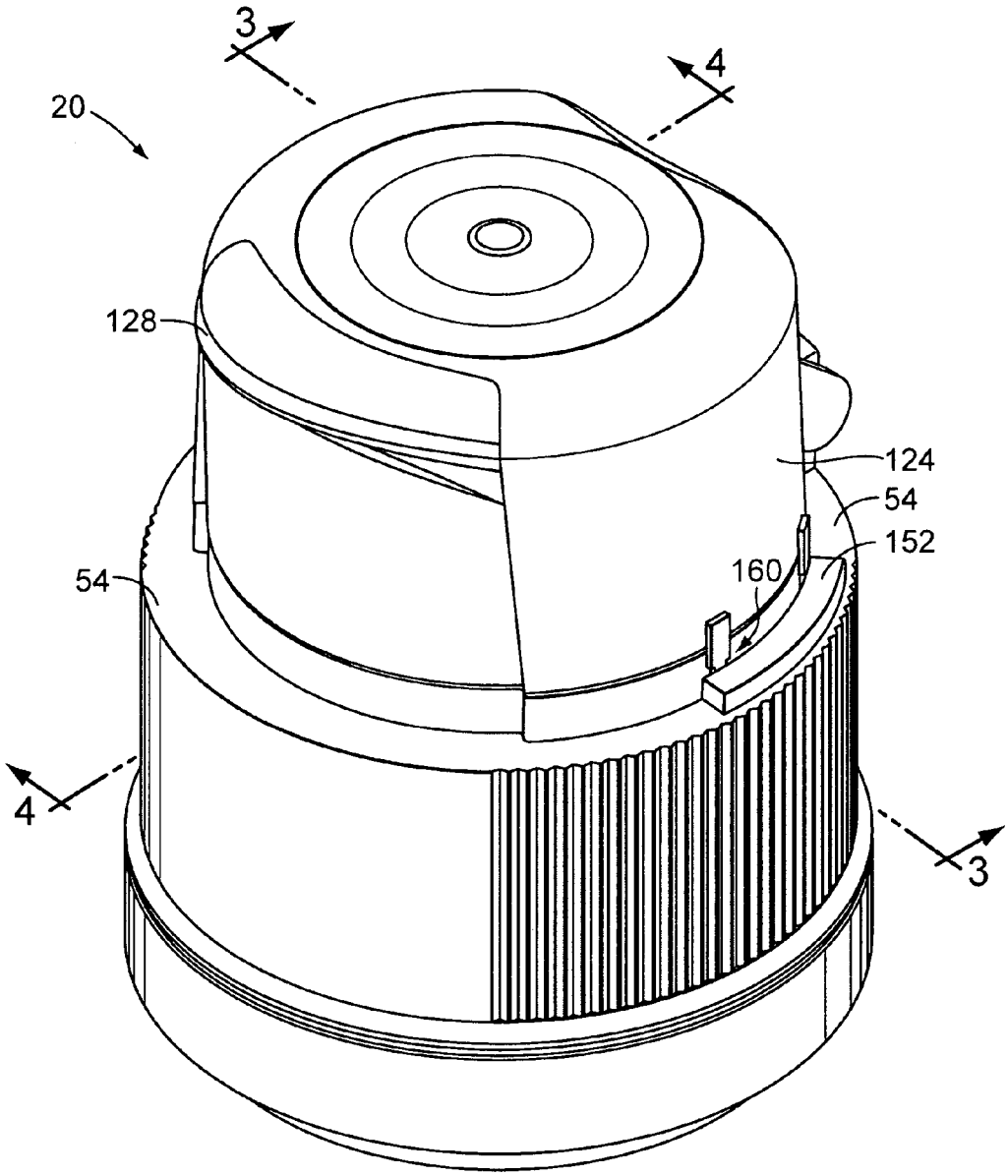
FIG. 1 is a front, perspective view of an exemplary dispensing closure system in the form of a separate dispensing closure according to a preferred embodiment of the invention, and the closure is shown in a closed configuration, before installation on a container, and from a vantage point generally above, or from the top of, the closure.
Figure 3:
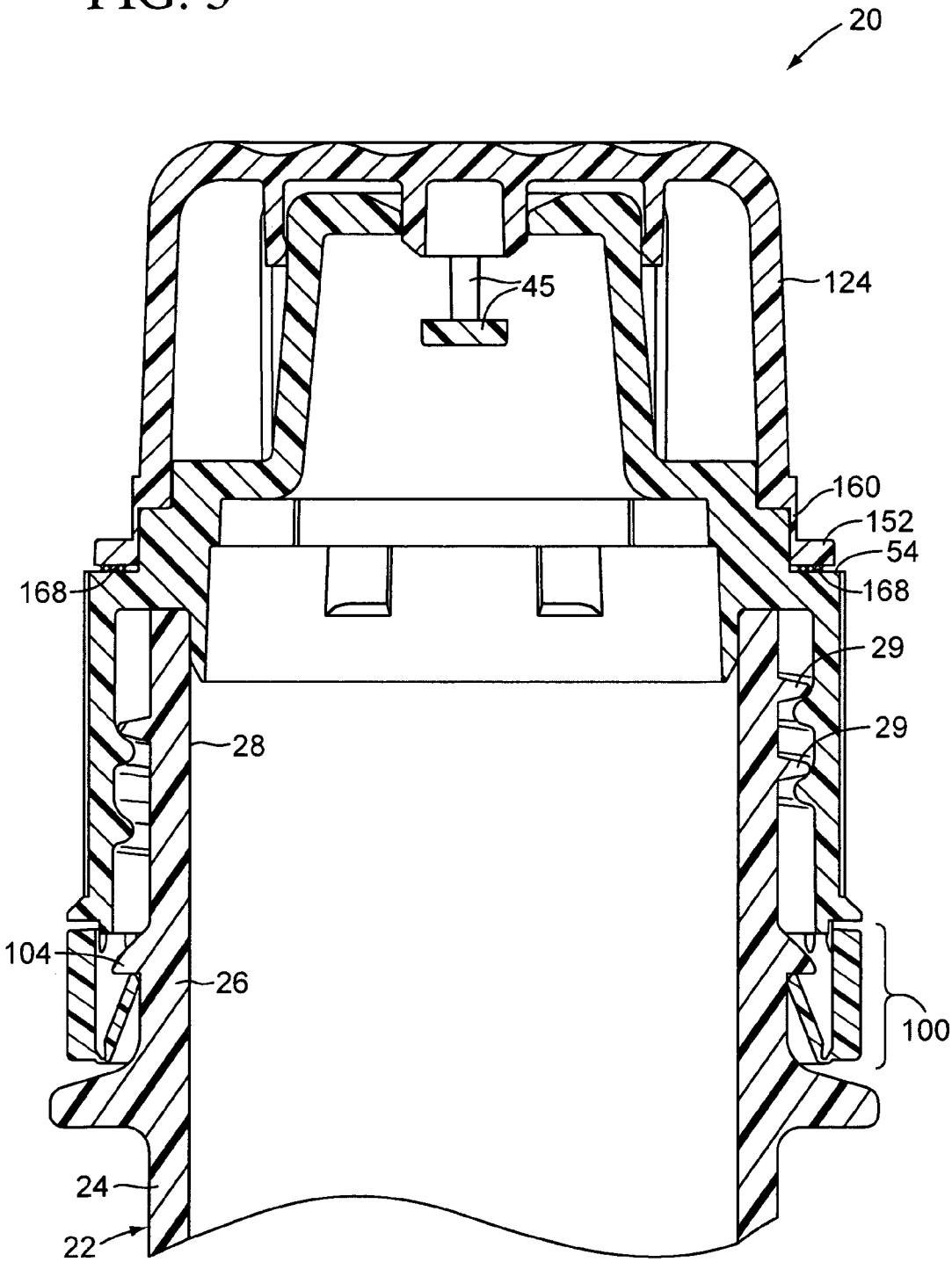
FIG. 3 is an enlarged, fragmentary, cross-sectional view taken generally along the plane 3-3 in FIG. 1, but FIG. 3 further shows the closure installed on the neck of a container and shows part of the lower tamper-evident band of the closure turned upwardly to engage a flange on the container neck.

A presently preferred embodiment of a closure system of the present invention is illustrated in FIG. 1 et seq, and is designated generally therein by reference number 20 in FIG. 1. In the preferred embodiment illustrated, the closure system 20 is provided in the form of a separate, dispensing type closure 20 which is adapted to be mounted or installed on a container 22 (FIG. 3) that would typically contain a fluent material. The container 22 includes body 24 and a neck 26 as shown in FIG. 3. The neck 26 defines an opening 28 to the container interior. The container neck 26, in the preferred embodiment illustrated in FIG. 3, has an external, male thread 29 for engaging the closure 20.

The body 24 of the container 22 may have any suitable configuration, and the upwardly projecting neck 26 may have a different cross-sectional size and/or shape than the container body 24. Alternatively, the container 22 need not have a neck 26, per se. Instead, the container 22 may consist of just a body with an opening. The container 22 may have a rigid wall or walls, or may have a somewhat flexible wall or walls.

Although the container, per se, does not necessarily form a part of the broadest aspects of the present invention, per se, it will be appreciated that at least a body portion of the closure system 20 of the present invention optionally may be provided as a unitary portion, or extension, of the top of the container. However, in the preferred embodiment illustrated, the closure system 20 is a separate assembly (e.g., a closure) of two pieces, and is adapted to be removably or non-removably installed on a previously manufactured container 22 that has an opening 28 to the container interior. Hereinafter, the closure system 20 will be more simply referred to as the closure 20.

The closure 20 is adapted to be used with a container 22 having an opening 28 to provide access to the container interior and to a product contained therein. The closure 20 can be used with many materials, including, but not limited to, relatively low or high viscosity liquids, creams, gels, suspensions, mixtures, lotions, pastes, particulates, granular materials, small pieces or items, etc. as constituting a food product, a personal care product, an industrial or household cleaning product, or other compositions of matter (e.g., compositions for use in activities involving manufacturing, commercial or household maintenance, construction, agriculture, etc.).

The container 22 with which the closure 20 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable wall container is preferred in many applications but may not be necessary or preferred in other applications. For example, in some applications it may be desirable to employ a generally rigid container, and to pressurize the container interior at selected times with a piston or other pressurizing system. Also, the interior of the container need not be pressurized at all. Instead, if the closure is large enough, the product could be accessed by reaching through the open closure with a hand, spoon or straw, or the package could be inverted to let the product discharge through the opened closure solely under the influence of gravity.

In other designs, a flexible, slit valve could be included in the closure for dispensing product when the lid is opened. Such a valve could open to accommodate dispensing of a fluid under the influence of a differential pressure acting across the valve (as may be created, for example, if suction (i.e., reduced pressure) is applied to the exterior of the valve, and/or if the pressure inside the container is increased).

It is presently contemplated that many applications employing the closure 20 will conveniently be realized by molding some or all of the components of the closure 20 from suitable thermoplastic material or materials. In the preferred embodiment illustrated, the components of the closure could each be molded from a suitable thermoplastic material, such as polyethylene or polypropylene. The closure components may be separately molded from the same material or from different materials. The materials may have the same or different colors and textures.

Figure 5:
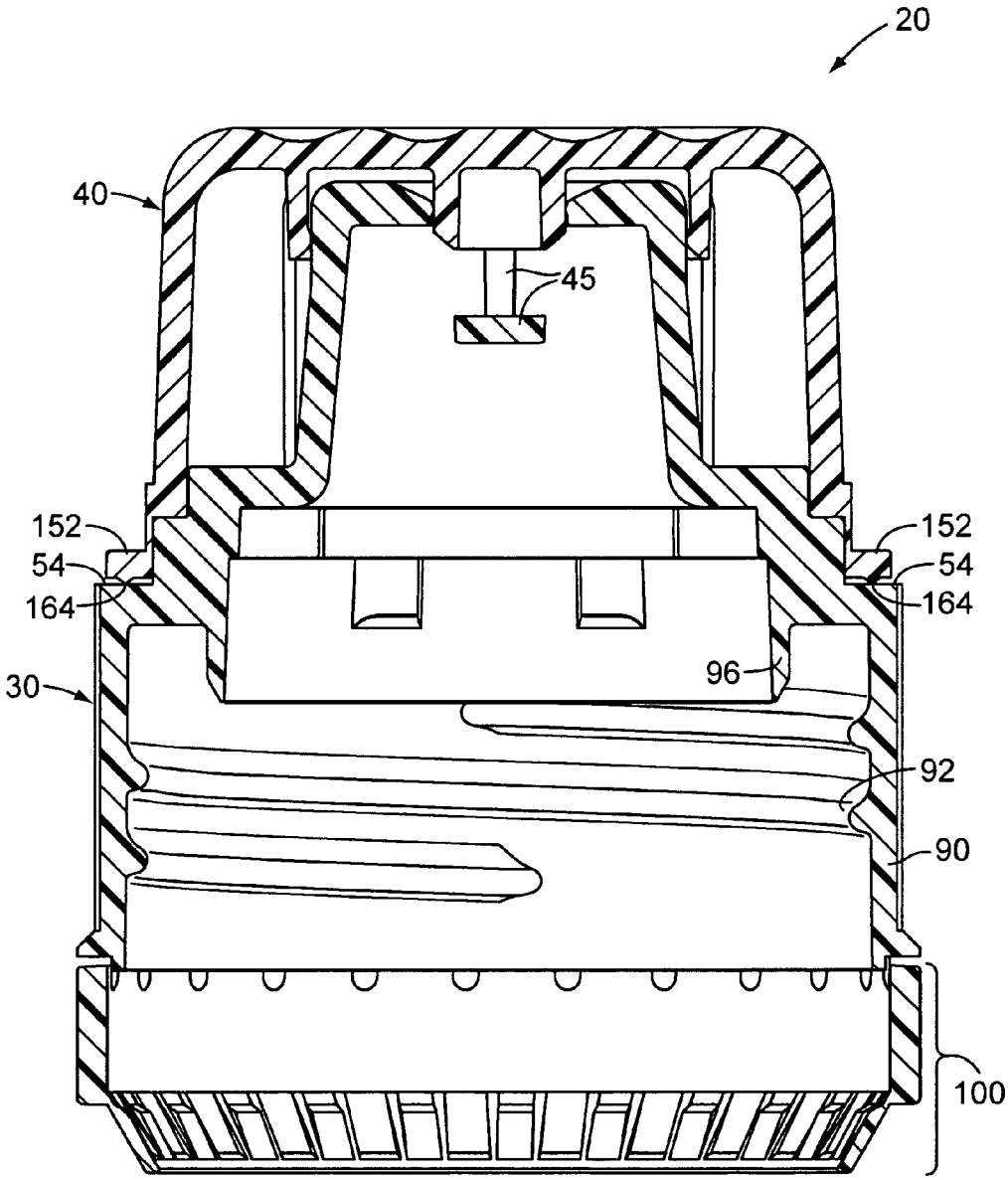
FIG. 5 is an enlarged, cross-sectional view similar to FIG. 3, but FIG. 5 shows the closure (1) prior to the lid anchor members being welded to the closure body, and (2) prior to the closure being installed on the neck of a container, and FIG. 5 further shows the lower tamper-evident band in the as-molded, downwardly depending configuration prior to being turned up under the flange on the container neck.

As can be seen in FIG. 5, the closure system or closure 20 includes, two basic components, (1) a base or body 30, and (2) a lid 40 which is adapted to be carried on the body 30. The closure 20 may also include optional tamper-evident features as described in detail hereinafter. The optional, tamper-evident features do not form a necessary part of the present invention.

Figure 2:
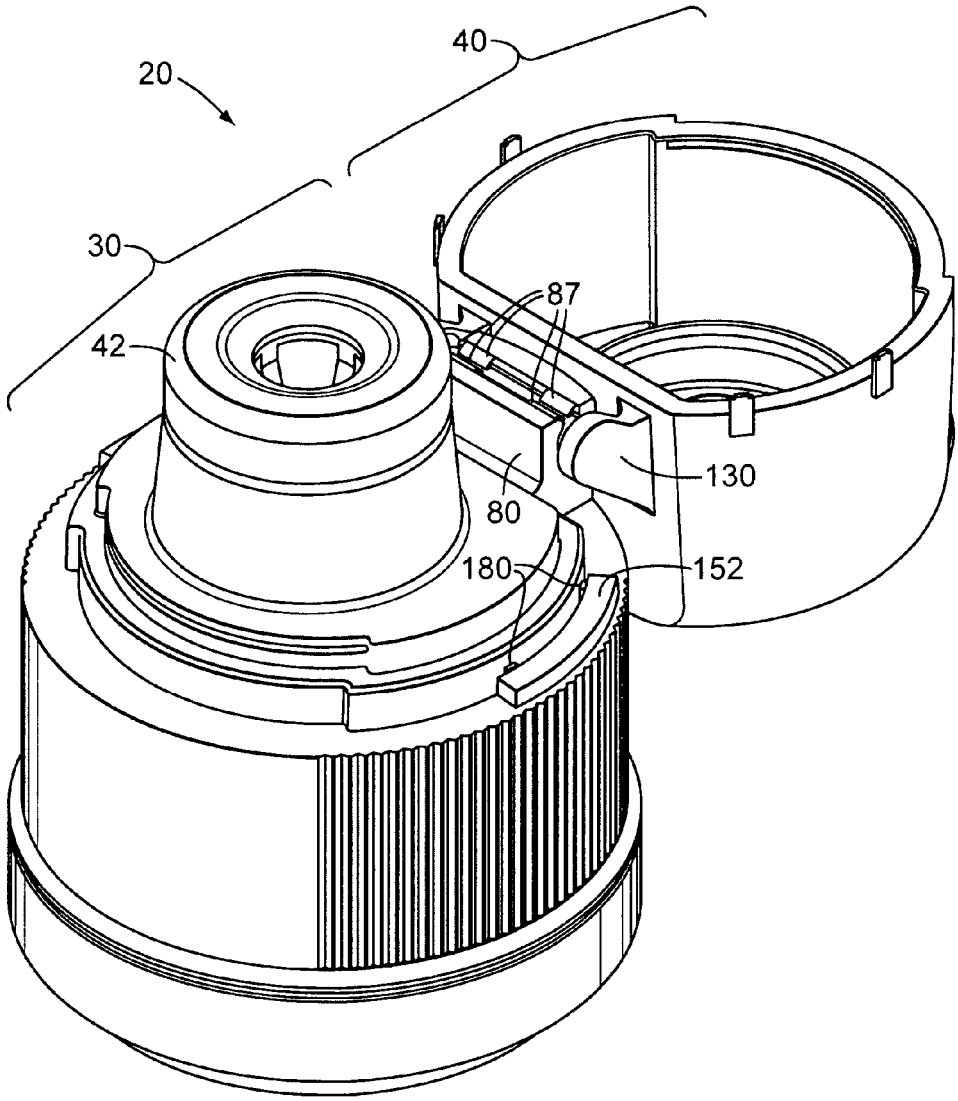
FIG. 2 is a view similar to FIG. 1, but FIG. 2 shows the lid in the open position with a tamper-evident feature having been broken.

The lid 40 is pivotable between a closed position over the body 30 as shown in FIG. 1 and an open position as shown in FIG. 2. The lid 40 is manufactured (e.g., preferably molded from thermoplastic material) as a component which is initially completely separate from the closure body 30. The detailed structure of the presently preferred form of the lid 40 is described in detail hereinafter.

After the closure body 30 is initially molded, the lid 40 is assembled (as described in detail hereinafter) in a way that (1) establishes a secure retention of the lid 40 to the body 30, and (2) accommodates the pivoting movement of the lid 40 while preventing removal of the lid 40 from the body 30. The structure of the closure body 30 will next be described in detail.

Figure 4:
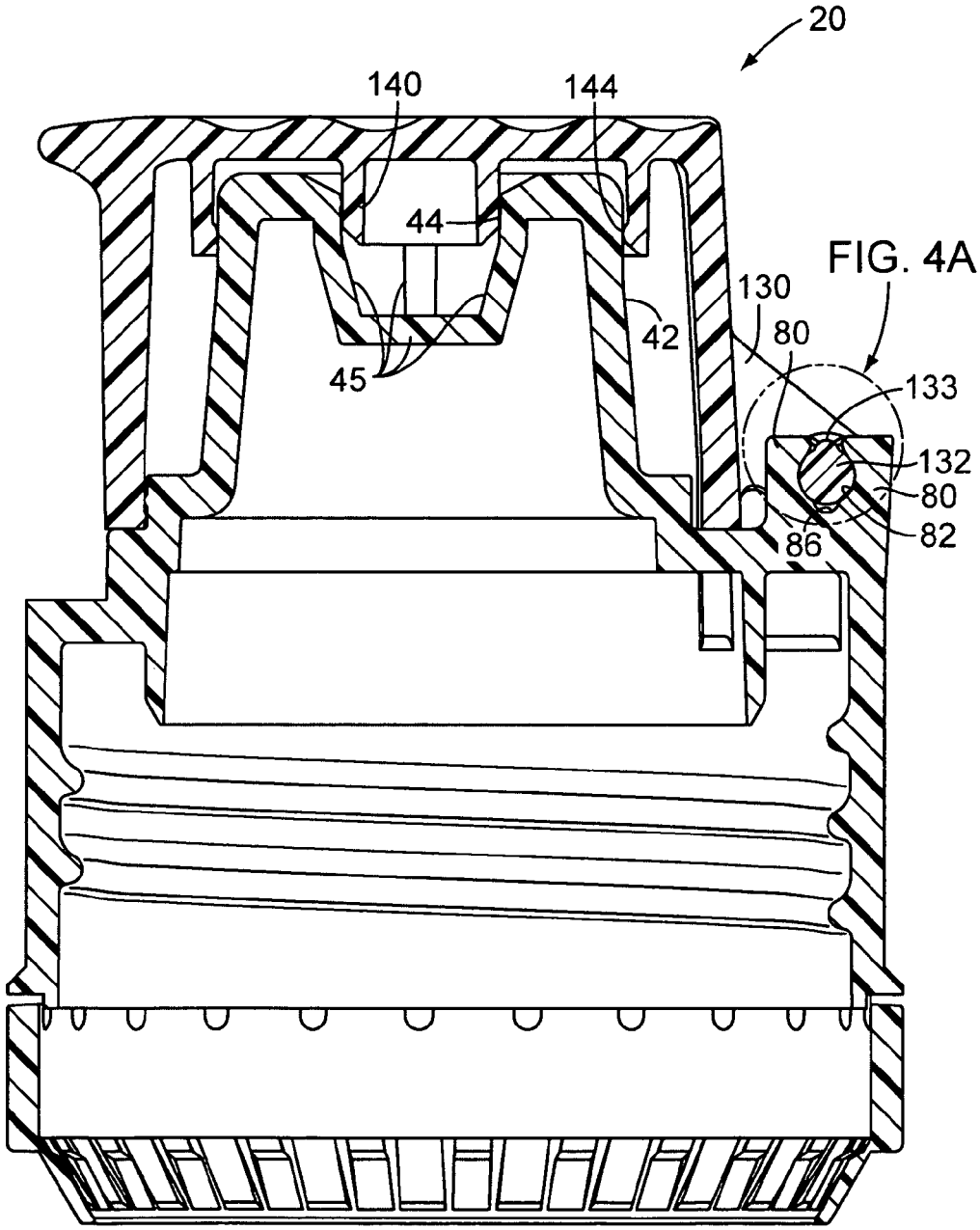
FIG. 4 is an enlarged, cross-sectional view taken generally along the plane 4-4 in FIG. 1.
Figure 7A:
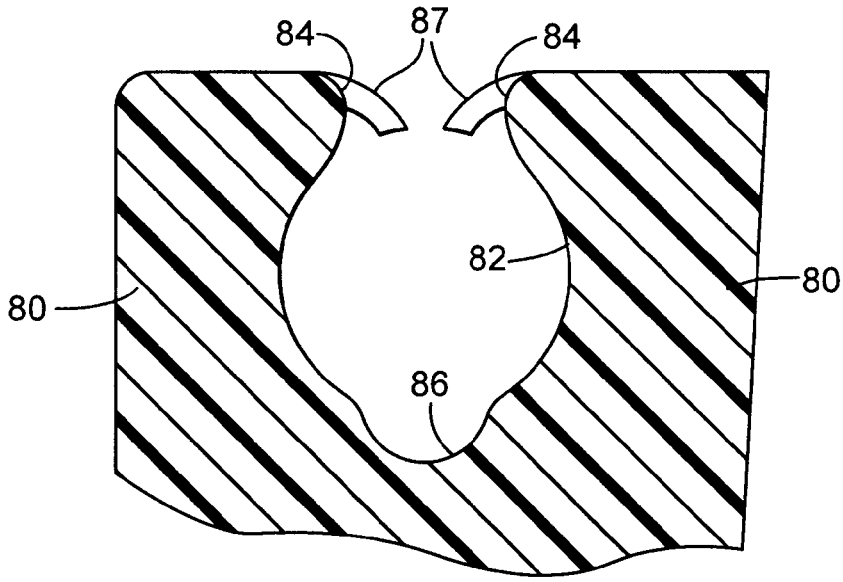
FIG. 7A (on drawing sheet 6/13 with FIG. 4A) is a greatly enlarged, fragmentary, cross-sectional view of the area within the circle designated FIG. 7A in FIG. 7.
Figure 6:
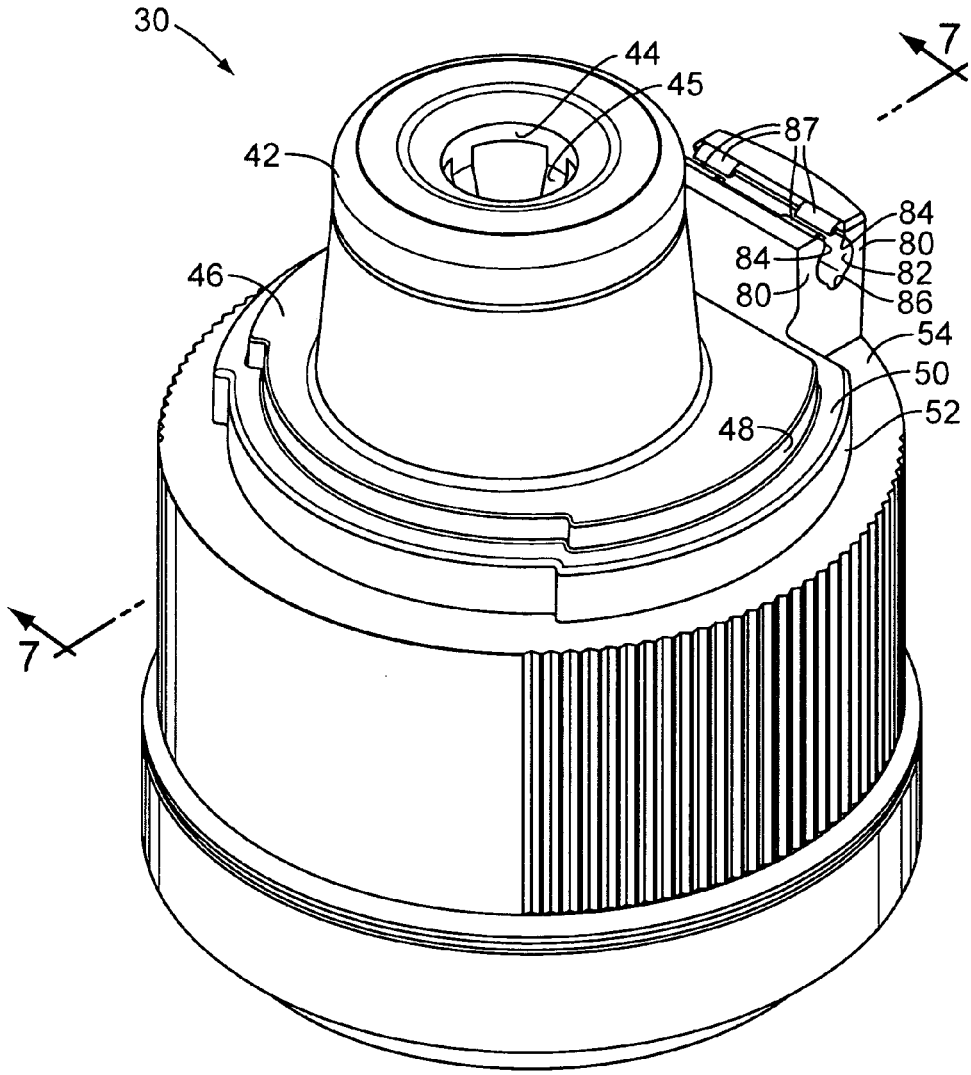
FIG. 6 is a perspective view of the closure body prior to the lid being initially mounted on the body by the manufacturer and prior to the completed closure being installed on the container.
Figure 7:
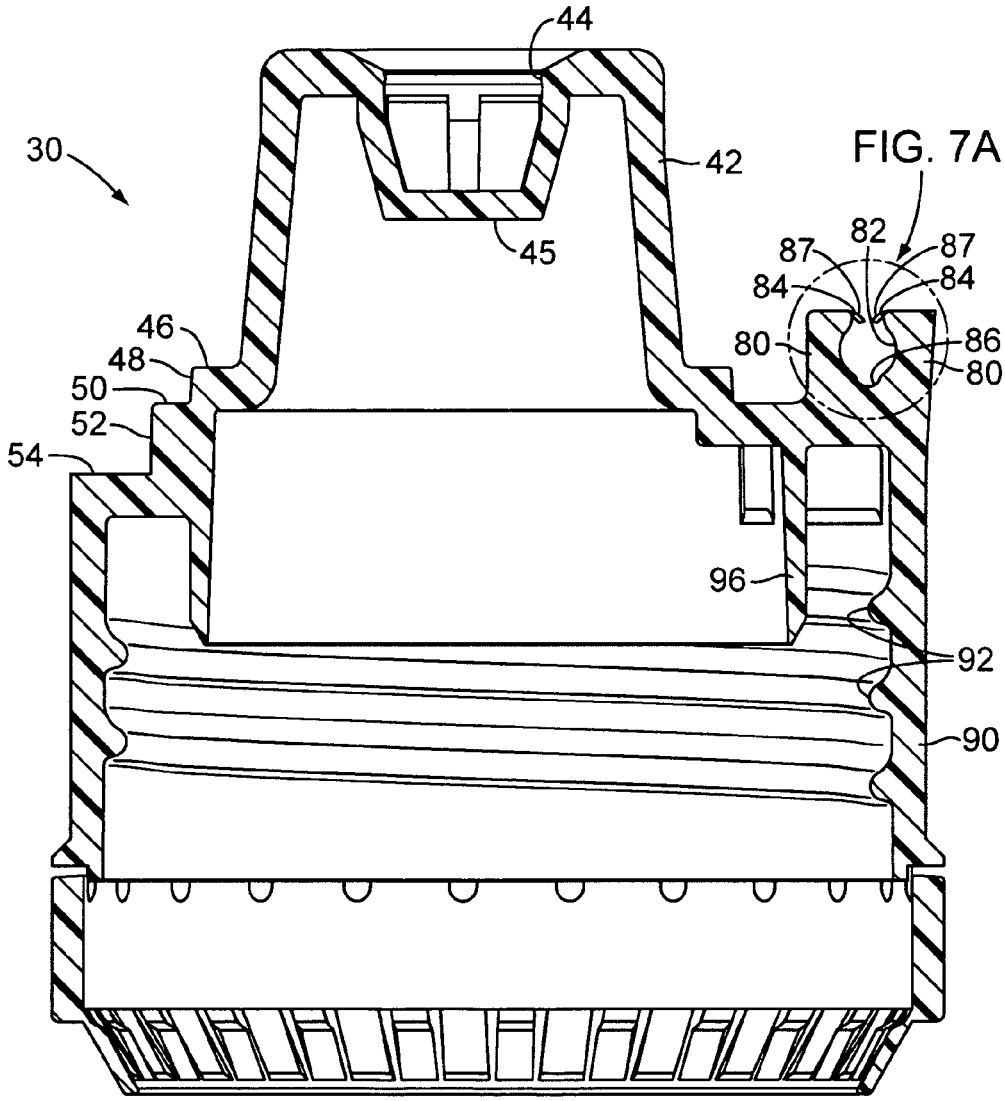
FIG. 7 is a enlarged, cross-sectional view taken generally along the plane 7-7 in FIG. 6.

As can be seen in FIG. 7, the closure body 30, as initially molded, includes a spout 42 defining a dispensing orifice 44 which opens to the hollow interior of the closure body 30 and which therefore communicates with the opening 28 in the container neck 26 when the closure 20 is mounted on the container 22 as shown in FIG. 4. The interior of the spout 42 contains an apertured baffle structure 45 (FIGS. 3-7) for controlling the flow of the discharging fluid product. The baffle structure 45 may be omitted altogether, or other spout interior structures may be included (e.g., a discharge valve).

As shown in FIGS. 6 and 7, at the bottom of the spout 42, the closure body 30 has a peripheral upper deck 46. The peripheral upper deck 46 is defined at its outer edge by a generally vertical wall 48 as can be seen in FIGS. 6 and 7. Surrounding the lower edge of the vertical wall 48 is an intermediate deck 50. The intermediate deck 50 is defined at its outer edge by a generally vertical wall 52. At the bottom edge of the vertical wall 52 is a lower deck 54. The lower deck 54 defines an attachment surface and functions to accommodate a thermoplastic weld attachment of an optional, tamper-evident feature on the lid 40 as described in detail hereinafter.

As can be seen in FIGS. 6, 7, and 7A, the rear of the closure body 30 includes a receiving structure or bearing member comprising two, spaced-apart, portions or walls 80 which together define between them an upwardly open channel 82. As shown in FIG. 7, the upper, distal end portion of each wall 80 extends toward the other wall 80 over the channel 82 to define a reduced width passage 84 to the channel 82. The bottom of the channel 82 includes a narrower recess or groove 86.

As can be seen in FIGS. 6 and 7A, a pair of spaced-apart, cantilevered, arcuate, resilient, downwardly extending, laterally deflectable, retention fingers 87 project partly over the channel 82 from the top end of each wall 80. Each finger 87 is shaped (e.g., curved) to accommodate its temporary, elastic, deflection downwardly and toward the side of the channel 82 when engaged by a hinge pivot shaft of the closure lid 40 as the lid 40 is mounted to the closure body 30 as described in detail hereinafter.

As used herein, walls 80 are portions of material on either side of, and defining, the channel 82. Each wall 80 may actually be very thick, and merge into, or be part of, a larger surrounding structure of the closure body 30. Each wall 80 may actually be in an "upper" portion of the closure body 30 as in the preferred embodiment illustrated in FIGS. 6 and 7.

As can be seen in FIGS. 6 and 7, the closure body 30 has an annular skirt 90 extending downwardly form the upper portion of the closure body 30. The interior surface of the skirt 90 defines a female thread 92. As illustrated in FIG. 5, the closure body skirt thread 92 is adapted to threadingly engage the exterior, male thread 29 on the container neck 26.

Alternatively, the closure skirt 90 could be provided with some other container connecting means, such as a snap-fit bead or groove (not illustrated) in place of the thread 92 for engaging a container neck groove or bead (not illustrated), respectively. The closure body 30 could also be permanently attached to the container 22 by means of induction melting, ultrasonic melting, gluing, or the like, depending on materials used for the closure body 30 and container 22. The closure body 30 could also be formed as a unitary part, or extension, of the container 22.

The closure body skirt 90 may have any suitable configuration for accommodating an upwardly projecting neck 26 or other portion of the container 22 received within the particular configuration of the closure body 30, and the main part of the container 22 may have a different cross-sectional shape than the container neck 26 and closure body 30.

An optional seal or liner (not illustrated) may be sealed across the top of the container neck 26 or, alternatively, may be sealed across an interior region or underside of the upper portion of the closure body 30. However, if the function of a tamper-evident seal or freshness seal as provided by such a liner is not needed or desired in a particular application, then the liner may, of course, be omitted.

Also, if desired, the closure body 30 may be provided with an interior, annular seal 96 (FIGS. 6 and 7) extending downwardly from the underside of the upper portion of the closure body 30. Such a seal 96 could be "plug" profile seal, as illustrated, or a "crab's claw" seal, or some other such seal, depending upon the particular application and depending upon whether or not a liner is employed.

In the preferred form of the closure illustrated, the closure body skirt 90 has a generally annular configuration. However, the closure body skirt 90 may have other configurations. For example, the closure body skirt 90 might have a prism or polygon configuration adapted to be mounted to the top of a container neck having a polygon configuration. Such prism or polygon configurations would not accommodate the use of a threaded attachment, but other means of attachment could be provided, such as a snap-fit bead and groove arrangement, or the like. However, if the closure body included a double wall defining a polygon outer skirt and a cylindrical inner attachment wall, then the cylindrical inner attachment wall could be provided with a thread for engagement with a threaded container.

In one preferred form of the closure as shown in FIG. 5, the closure body 30 incorporates a conventional or special tamper-evident ring 100 along the bottom edge of the closure body skirt 90 for cooperation with a container 22 that has a retention flange 104 (FIG. 3) below the container neck thread 26. As shown in FIG. 5, the tamper-evident ring 100 is initially molded as a downwardly extending, unitary flange on the bottom of the closure body skirt 90. Prior to the installation of the closure body 30 on a container, such as on the container 22 illustrated in FIG. 3, the lower half of the tamper-evident ring 100 is deformed or bent radially inwardly and upwardly. Then, the closure body 30 is lowered onto the container neck 26 and threadingly rotated relative to the container neck 26. The upwardly bent tamper-evident ring 100 passes over the container neck thread 29 and over the container neck retention flange 104. The upwardly bent portion of the tamper-evident ring 100 snaps inwardly below the container neck retention flange 104 as shown in FIG. 3. This resists removal of the closure body 30 if a user attempts to rotate the closure body 30 in an unscrewing direction. However, the tamper-evident band or ring 100, in the preferred form, is connected to the bottom end of the closure body skirt 90 by a very thin portion or portions of material (which may have, for example, circumferentially spaced-apart notches or a scored groove or a molded groove (not shown)). If the user attempts to unscrew the closure body 30 with a sufficient amount of torque, then the interconnecting, thin portion of material will break, and the tamper-evident band 100 will separate from the bottom of the closure body skirt 90. This will serve as an indication that the closure body 30 has been unscrewed, at least partially, from the fully assembled configuration.

The use of a tamper-evident ring or band 100 is an entirely optional feature of the illustrated embodiment, and it does not form a necessary part of the present invention. Indeed, if the closure body 30 is non-releasably attached to the container neck 26 (as with adhesive, thermal bonding, irreversible snap-fit configurations, etc.), then the tamper-evident ring 100 would provide no additional benefit. Similarly, a tamper-evident ring 100 would provide no additional benefit if the closure body 30 is formed as a unitary molded extension of the container neck 26.

Figure 8:
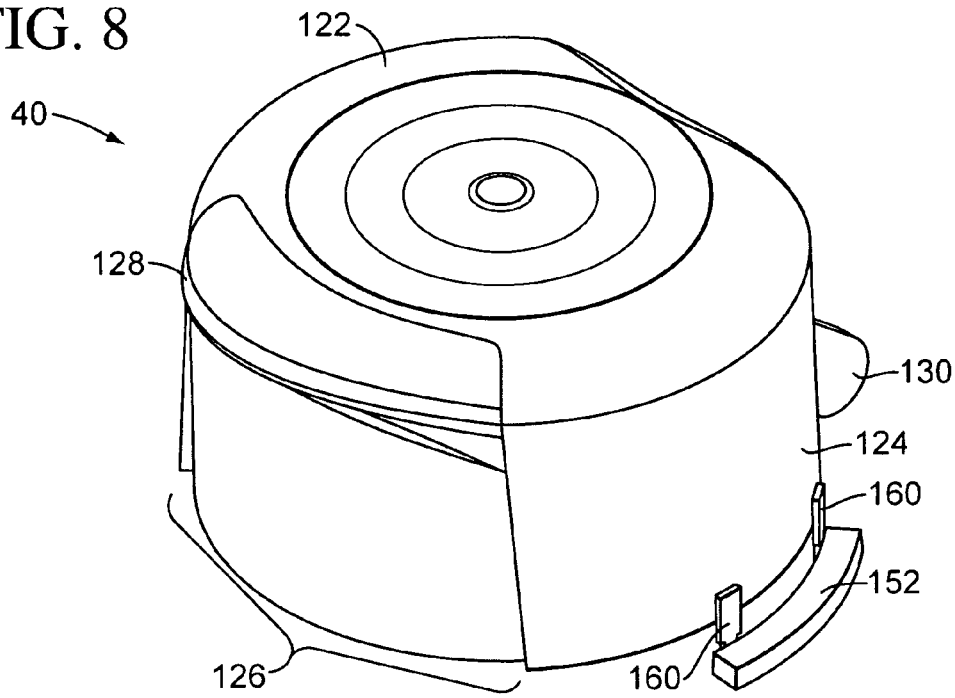
FIG. 8 is a front perspective view of the closure lid prior to the lid being mounted on the closure body by the manufacturer.
Figure 9:
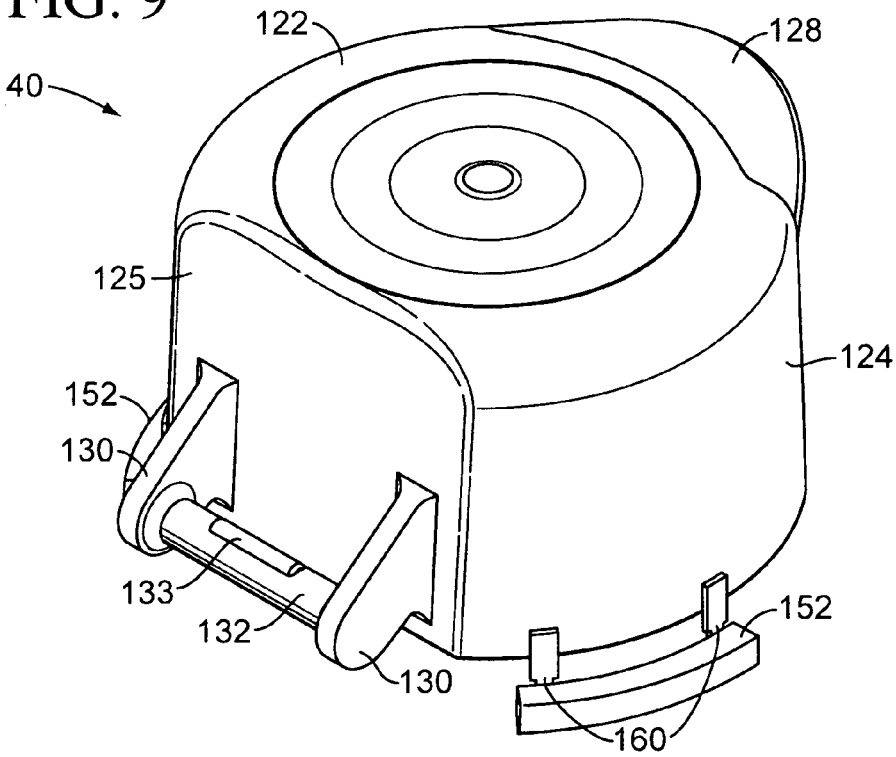
FIG. 9 is a rear perspective view of the lid prior to the lid being mounted on the closure body by the manufacturer.

As shown in FIGS. 8 and 9, the lid 40 includes a top wall 122 and a skirt 124. The front of the lid 40 has an indentation or recess 126 in the skirt 124. A thumb lift tab 128 projects outwardly from the top portion of the lid 40 over the recess 126. As can be seen in FIG. 9, the skirt 124 has a flat wall section 125 at the rear of the lid 40. Projecting outwardly from the flat wall section 125 is a pair of rearwardly extending lugs 130. A shaft 132 extends between, and connects, the lugs 130 at a location where the shaft 132 is spaced from the lid skirt flat wall section 125. The shaft 132 has a centrally located, outwardly projecting ridge or bead 133.

Figure 1A:
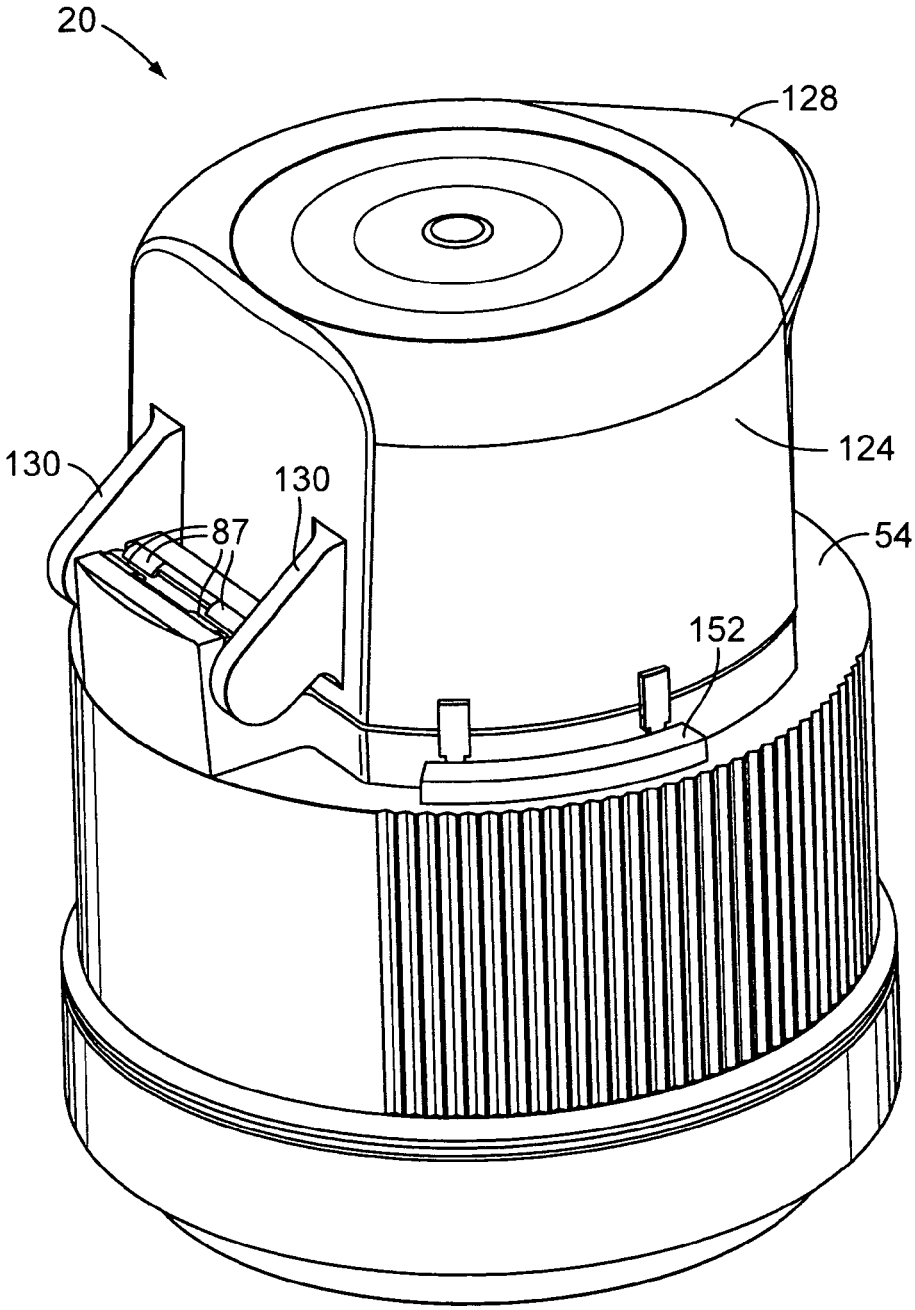
FIG. 1A is a rear, perspective view of the dispensing closure system shown in FIG. 1.
Figure 4A:
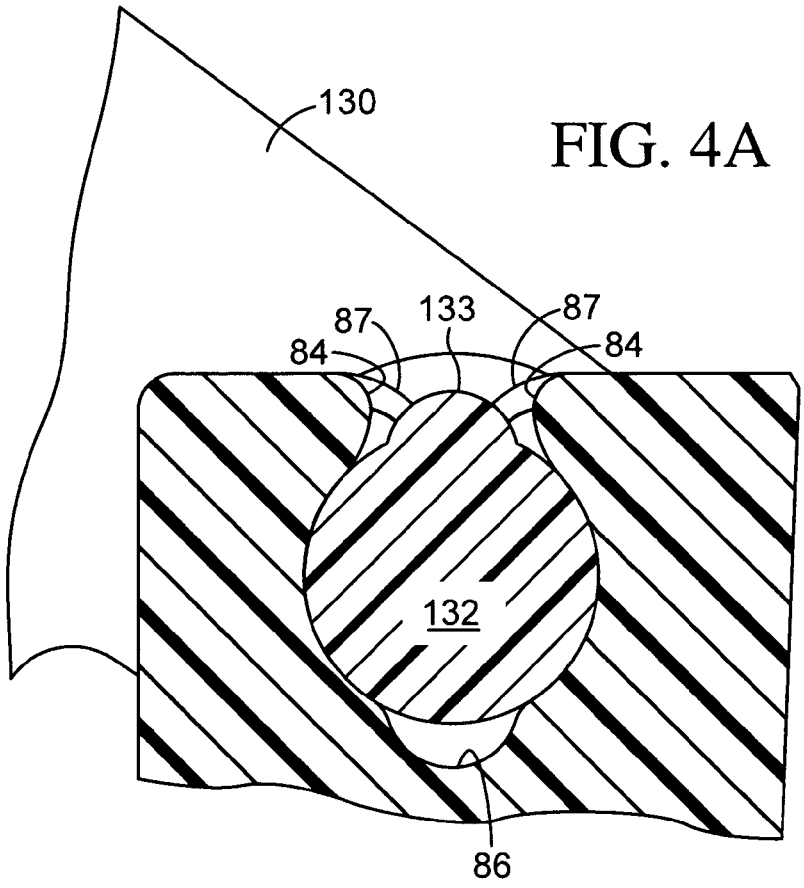
FIG. 4A is a more greatly enlarged, fragmentary, cross-sectional view of the area within the circle 4A in FIG. 4.

In the preferred embodiment, the ridge 133 does not extend along the entire length of the shaft 133 (see FIG. 9), and thus, there is space at each end of the shaft 132 for receiving the distal ends of the closure body fingers 87 (FIG. 1A) when the lid 40 is initially mounted in a closed position on the body 30 so that the lid pivot shaft 132 is received within the upwardly open channel 82 defined at the rear of the closure body 30 (FIGS. 4 and 4A). The lid pivot shaft 132 must be forced downwardly past the fingers 87. The fingers 87 can be deflected downwardly and laterally by the shaft 132. However, even as the fingers 87 are deflected laterally away from the shaft 132 and toward the channel walls 80, the upper ends of the walls 80 also temporarily spread apart because the width dimension of the shaft 132 is greater than the opening 84 at the base of each finger 87 at the upper end of the wall 80 from which the finger 87 projects. The walls 80 and fingers 87 are sufficiently resilient so that, after the shaft 132 has been fully seated within the channel 82, the upper ends of the walls 80 and the fingers 87 return to the original, substantially unstressed condition (FIG. 4A).

This provides a snap-fit engagement that holds the lid shaft 132 on a fixed axis relative to the closure body 30 so as to accommodate pivoting movement of the lid 40 relative to the closure body 30 between the full closed position (FIG. 1) and the full open position (FIG. 2). The shaft ridge or bead 133 (FIG. 4) is received in the groove 86 (FIGS. 4 and 6) at the bottom of the channel 82 when the lid 40 is fully opened (FIG. 2) to provide a detent engagement that increases the resistance to rotation of the lid 40 away from the open position.

The curved fingers 87, in conjunction with the upper, distal ends of the walls 80, function as a positive retention system preventing withdrawal of the hinge shaft 132 from the channel 82.

In the illustrated, preferred embodiment, each wall 80 has two spaced-apart fingers 87—a total of four fingers 87. However, the present invention also contemplates that only one finger 87 could be employed instead four fingers. In such an alternate embodiment (not illustrated), one deformable finger 87 would extend from one of the two walls 80 and would have a length sufficient to prevent removal of the lid shaft 132 from the channel 82. In such an alternate design, the one finger 87 could be either on the inboard side of the channel 82 (i.e., between the channel 82 and the spout 42), or on the outboard side of the channel 82.

The present invention also contemplates other alternative designs. For example, two fingers 87 could be provided, one on one side of the channel 82, and one on the other side of the channel 82.

Also, in another alternate design (not illustrated), only two spaced-apart fingers could be provided—but on the same side of the channel 82, either on the inboard side or on the outboard side.

Also, more than two spaced-apart fingers could be provided on each wall 80. Indeed, the number of fingers provided at the top of one wall could be different than the number of fingers provided at the top of the other wall.

Figure 12:
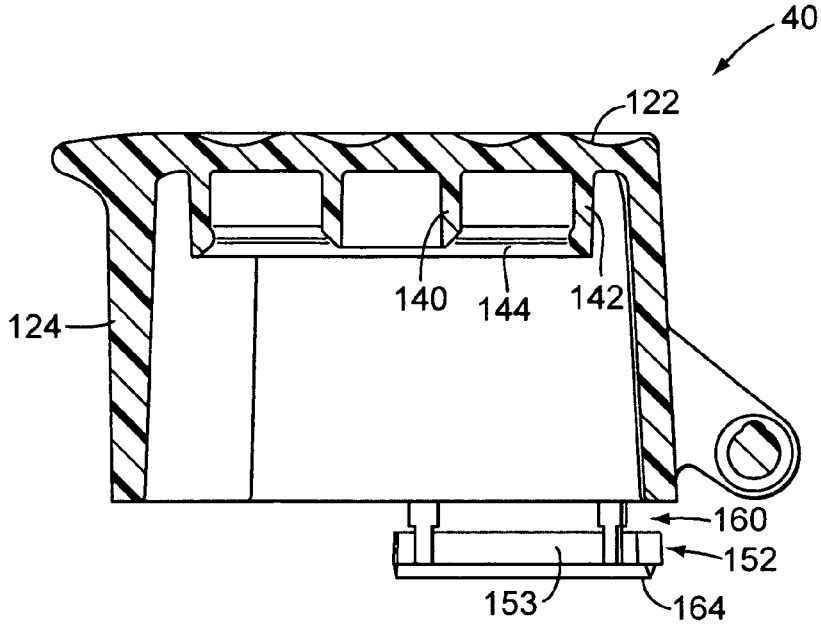
FIG. 12 is a cross-sectional view taken generally along the plane 12-12 in FIG. 10.

As can be seen in FIG. 12, the lid 40 optionally may include, and preferably includes, a plug or spud 140 projecting downwardly from the underside of the lid top wall 122. An annular sealing member 142 projects from the underside of the lid 40 around the spud 140. The member 142 has a radially inwardly projecting sealing bead 144. As shown in FIG. 4, the spud 140 is adapted to be received within the dispensing orifice 44 of the spout 42. In the preferred embodiment illustrated in FIG. 4, the dispensing orifice 44 is a substantially cylindrical orifice, and the exterior of the lid plug or spud 140 has a generally cylindrical surface. The diameter of the exterior surface of the lid spud 140 is slightly greater than the internal diameter of the body dispensing orifice 44. This provides an interference fit to effect good sealing engagement. Either the spud 140 or the spout 42, or both, have sufficient flexibility to accommodate such an interference fit providing leak-tight sealing capability. The lid sealing member 142 and its bead 144 are optional features that may be included so that the bead can sealingly engage the upper, exterior surface of the spout 42. The spud 140 is also an optional feature. The closure 20 could alternatively be provided with just the spud 140 alone, or the lid member 142 alone, or both the spud 140 and lid member 142 (as in the illustrated, preferred embodiment).

Although not part of the present invention per se, an optional tamper-evident feature may be provided for indicating that the lid 40 has been initially moved away from the fully closed configuration (FIG. 1) toward the fully opened position (FIG. 2). The tamper-evident feature involves cooperation between the lid 40 and closure body 30. As shown in FIGS. 1, 2, 7, and 9, the tamper-evident feature includes at least one anchor member 152 which is initially connected to the lid 40 with one or more frangible members or webs 160. The combination of the lid 40, webs 160, and anchor members 152 may be characterized as a top structure for being initially mounted on, and attached to, the closure body 30.

There are two anchor members 152—one provided on each side of the lid 40 along the bottom edge of the lid 40, but spaced a distance Y (FIGS. 14-16) below the lid skirt bottom edge. As illustrated in FIGS. 8 and 9, there are a plurality of frangible webs 160 in the form of spaced-apart bridges extending between each anchor member 152 and the lid skirt 124.

Figure 13:
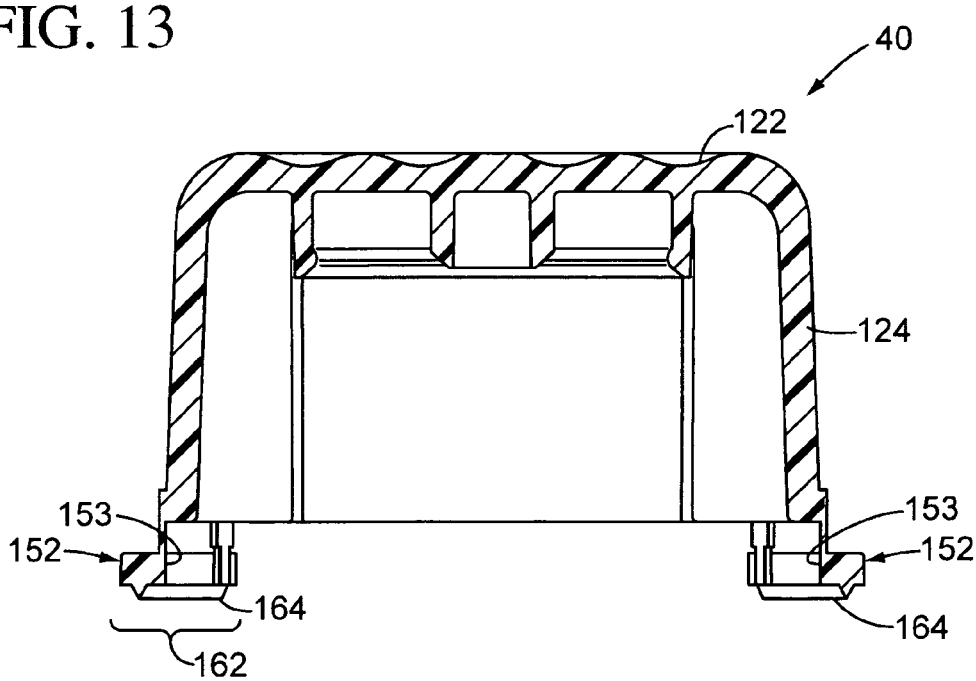
FIG. 13 is a cross-sectional view taken generally along the plane 13-13 in FIG. 10.

In the illustrated preferred embodiment, each anchor member 152 includes a generally vertically inner surface 153 (FIGS. 12 and 13) that faces radially inwardly and that is connected to the lower portion of each frangible web 160. The webs 160 are initially molded simultaneously with, and as part of the unitary top structure that includes, the lid 40 and anchor members 152. Each anchor member 152 is a generally arcuate bar. In other contemplated embodiments (not illustrated), each anchor member need not be an arcuate bar. Each anchor member 152 includes an attaching portion 162 (FIGS. 13 and 14) which, in the illustrated preferred embodiment, is defined by the underside or bottom surface of the member 152. Preferably, the attaching portion 162 is initially molded as the bottom surface of the anchor member 152 and also includes a downwardly projecting protuberance 164 that has a triangular transverse cross section for facilitating the thermoplastic welding attachment of the anchor member 152 to the closure body attachment surface 54 as described in detail hereinafter.

In the presently contemplated, preferred form of the optional tamper-evident feature, the manufacturer can readily mold the lid 40, webs 160, and anchor members 152 (with the protuberances 164) together as a single, unitary component (i.e., the "top structure"), and the manufacturer can separately mold the closure body 30 as another, separate component. The top structure and body 30 may be molded from the same thermoplastic material or from different thermoplastic materials. The lid 40, webs 160, anchor members 152, and body 30 may have the same color and texture or may have different colors and/or textures.

After separately molding the closure body 30 and the top structure (i.e., the lid 40, webs 160, and anchor members 152 with protuberances 164), the two components are assembled by mounting the lid 40 on the closure body 30 so that the lid hinge shaft 132 is received in a snap-fit engagement within the closure body receiving channel 82. The lid 40 is initially closed on the closure body 30 as shown in FIG. 5. In the initially closed position of the lid 40, each anchor member 152 is disposed above the closure body lower deck 54 which defines the upwardly facing attachment surface. The lower, pointed edge of the anchor member attaching portion protuberance 164 rests on the closure body attachment surface (i.e., the upwardly facing surface of the closure body lower deck 54). The closure manufacturer can then (1) deform the upstanding deformable walls 87 (FIG. 7) over the lid shaft 132 as previously described, and (2) weld the anchor members 152 to the deck 54.

A presently preferred method for welding the optional tamper-evident anchor members 152 to the closure body lower deck 54 employs thermoplastic welding, and preferably thermoplastic welding as effected with ultrasonic energy. The triangular cross section protuberance 164 on the attachment portion 162 at the bottom of each anchor member 152 functions as an energy director for the ultrasonic energy. The ultrasonic energy can be applied with commercial ultrasonic welding equipment which may be of any suitable conventional or special design. Such ultrasonic welding equipment typically includes a suitable horn or engaging member for engaging the outwardly facing, exterior portions of the anchor members 152 and for applying a force against the anchor members 152 in a direction tending to urge the anchor members 152 downwardly toward the closure body lower deck attachment surface 54 at the same time that the ultrasonic equipment transfers ultrasonic energy into and through the anchor members 152. The equipment operating energy, time, force, etc. depend, of course, on the size and mass of the closure top structure components that are to be welded as well as upon the type of thermoplastic material. The detailed design and operation of such ultrasonic welding equipment form no part of the present invention.

In one presently preferred embodiment of the optional tamper-evident feature, the ultrasonic welding of the anchor members 152 to the closure body lower deck 54 is facilitated by providing the deck 54 with a textured surface. One such suitable textured surface can be provided by conventional etching of the relevant region of the mold steel through a conventional texture mask or plaque. In a preferred embodiment of the closure molded from polypropylene, the surface of the mold at the attachment surface 54 is AISI (American Iron and Steel Institute) type 420 stainless steel with a hardness of 54-64 Rockwell c that has been (1) ferric chloride acid attached to a depth of 0.052 mm. through a plaque or mask designated MT 11050 as sold by Mold Tech (having an office at 279 East Lies Road, Carol Stream, Ill. 60188, U.S.A.), and (2) bead blasted to remove ash residue.

During the welding of the anchor members 152 to the closure body deck 54, the energy director protuberances 164 (which may have a projection of about 0.55 mm. in a presently preferred embodiment) become softened and/or melted along with adjacent portions of the closure body deck 54. The softened or melted protuberances 164 and the softened or melted portions of the closure body deck 54, along with any softened or melted portions of the anchor member 152 adjacent the protuberances 164) fuse and re-solidify after termination of the application of the ultrasonic energy. This effects a welding of the thermoplastic material (as schematically designated by reference number 168 in FIG. 3).

Figure 14:
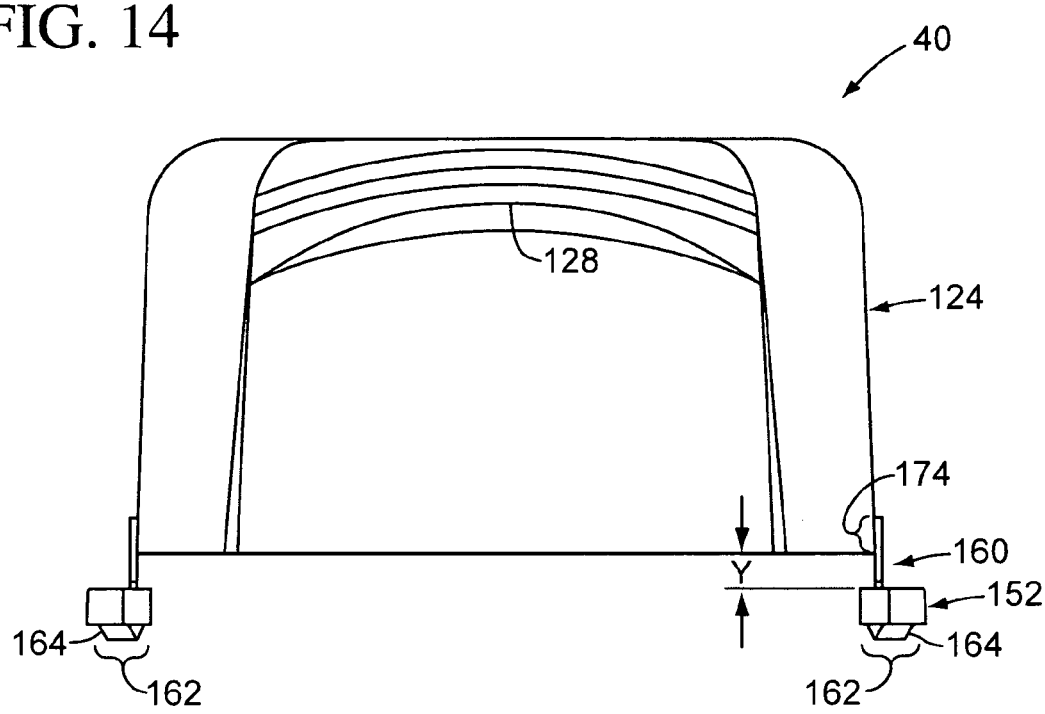
FIG. 14 is a front, elevational view of the lid taken generally along the plane 14-14 in FIG. 10.

With reference to FIG. 14, it can be seen that the frangible webs 160 extend downwardly for a distance Y below the bottom edge of the closure lid skirt 124 where the webs 160 adjoin the inner top edge of the anchor member 152. The frangible web 160 spans the gap Y between the top of the anchor member 152 and the bottom edge of the closure lid skirt 124.

When the user wishes to open the closure 20, the user applies a generally upwardly directed force to the closure lid thumb lift 128 (FIGS. 1 and 14). The application of a sufficiently large force will case the frangible webs 160 to break or rupture as illustrated in FIG. 2.

Before the lid 40 is lifted for the first time to break the frangible webs 160, the frangible webs 160 provide an indication that the lid 40 has not yet been opened. The user can readily see that the frangible web 160 are not ruptured because the frangible webs 160 span a relatively large gap having the height Y as shown in FIG. 14. The gap Y between the bottom edge of the lid skirt 124 and the top of the anchor member 152 provides a good background, field of view, or visual environment in which to readily ascertain that the frangible webs 160 are not broken (or are broken).

It will be appreciated that the optional, lid tamper-evident feature (comprising, inter alia, the anchor members 152 and frangible webs 160) may be omitted altogether if tamper-evidency is not desired. Alternatively, a completely different tamper-evident system could be employed for the lid.

When the closure 20 is in the full open condition as shown in FIG. 2, the user can tip or invert the package to facilitate the dispensing of fluent product under the influence of gravity. If the container 22 has a flexible wall or walls, the container 22 can be squeezed to further assist in dispensing the product. After the desired amount of product has been dispensed, the package can be turned back to its upright orientation, and the user can close the lid 40. If the package is designed for "inverted" storage (such as if the closure includes a flexible, pressure-actuatable, self-sealing dispensing valve), then the package may be left inverted at all times.

It will also be appreciated that the closure system of the present invention need not be provided as a separate closure for a container. The closure body 30 could instead be molded as a unitary part of the container 22. A container could be molded to have (1) an initially open bottom end, (2) a peripheral wall forming an upper end that defines a container top end opening, and (3) a unitary closure body portion extending radially inwardly from the container peripheral wall over the container top end opening so as to form a unitary part of the container top end and so as to define a unitary, top end closure body, including the spout 42 (and optionally including a hinge and lid, if the body, hinge, and lid are to be part of a single, unitary structure). Then, the container could be filled with product through the open bottom end, and the open bottom end could be subsequently sealed closed by appropriate means, such as with thermally assisted deformation or with a separate bottom closure plug or bottom cap.

It will also be appreciated that the closure system of the present invention may include other components, elements, or features. For example, the closure body 30 (FIG. 3) could include an internal valve system. The valve could be, for example, a pressure-actuated, flexible, resilient slit valve. Such a valve has the configuration and operating characteristics of a commercially available valve design substantially as disclosed in the U.S. Pat. No. 5,676,289 with reference to the valve 46 disclosed in the U.S. Pat. No. 5,676,289. The operation of such a type of valve is further described with reference to the similar valve that is designated by reference number 3*d* in the U.S. Pat. No. 5,409,144. The embodiment of the present invention shown in FIG. 7 herein could accommodate such a valve within the closure body spout 42 under the dispensing orifice 44 and within, or in place of, the baffle structure 45. Such a valve could be held in place with a suitable retainer ring in snap-fit engagement with the closure body. Alternatively, such a valve could be secured with other means, such as bi-injection molding, insert molding, adhesive securement, crimping, swagging or the like.

It will also be appreciated that beyond the region of the lid hinge shaft 132 and shaft retention structure in the body 30, the lid 40 and body 30 may have configurations and features other than those illustrated herein for the preferred embodiment. It will also be appreciated that the shapes of lid hinge pivot shaft 132, receiving channel 82, and deflectable fingers 87 need not be exactly as shown for the illustrated preferred embodiment.

The novel lid hinge shaft retention system of the present invention, which includes one or more deflectable fingers (e.g., fingers 87 in FIG. 7A), can be readily molded from thermoplastic material. The fingers 87 provide an enhanced, secure retention of the lid pivot shaft 132 in either the open or closed position.

It will be readily apparent from the foregoing detailed description of the invention and from the illustrations thereof that numerous variations and modifications may be effected without departing from the true spirit and scope of the novel concepts or principles of this invention.

What is claimed is:

1. A closure system for a container that has an opening to the container interior, said closure system consisting of unassembled components comprising:

a body which is either a separate structure for attaching to, and capable of extending from, said container at said opening or is a unitary extension of said container at said opening, said body having (1) at least one orifice for communicating with said container opening, (2) a bearing member comprising two spaced-apart walls which together define between them a channel with a reduced width passage that opens into a wider recess, and (3) at least one cantilevered, resilient, downwardly extending, laterally deflectable, retention finger projecting from one of said walls over at least a portion of said channel and that is shaped to accommodate temporary, elastic deflection relative to, and toward, said one wall from which it extends; and a lid adapted to be disposed on said body for accommodating lifting of said lid relative to said at least one orifice between (1) a closed position over said at least one orifice, and (2) an open position away from said at least one orifice, said lid including a pivot shaft for being received in said channel by being forced against and past said at least one retention finger which subsequently springs back over at least a portion of said channel; and wherein said retention finger has a distal end located in said reduced width passage to overlie a portion of the surface of said pivot shaft to define a positive retention system to prevent removal of said shaft from said channel.

2. The closure system in accordance with claim 1 in which said at least one retention finger is one of two downwardly extending, laterally deflectable, retention fingers that each projects from the same one of said two spaced-apart walls; and said body includes two of said retention fingers projecting from the other of said two spaced-apart walls.

3. The closure system in accordance with claim 1 in which said closure system is a closure for an end of said container wherein the container end defines said container opening; and said closure includes said body and said lid.

4. The closure system in accordance with claim 3 in which said closure is an article that is separate from said container; and said body is attachable to said container end over said container opening.

5. The closure system in accordance with claim 3 in which said closure body is a unitary part of said container and has (1) a peripheral wall that defines said container opening, and (2)

an upwardly projecting spout that extends above said container opening to define said at least one orifice.

6. The closure system in accordance with claim 1 in which each said deflectable retention finger is arcuate.

7. A closure system for a container that has an opening to the container interior, said closure system comprising:

a body which is either a separate structure for attaching to, and extending from, said container at said opening or is a unitary extension of said container at said opening, said body having (1) at least one orifice for communicating with said container opening, (2) a bearing member comprising two spaced-apart walls which together define between them a channel with a reduced width passage that opens into a wider recess, and (3) at least one cantilevered, resilient, downwardly extending, laterally deflectable, retention finger that projects from one of said walls over at least a portion of said channel and that is shaped to accommodate temporary, elastic deflection relative to, and toward, said one wall from which it extends; and a lid disposed on said body for accommodating lifting of said lid relative to said at least one orifice between (1) a closed position over said at least one orifice, and (2) an open position away from said at least one orifice, said lid including a pivot shaft disposed in said channel under said at least one retention finger; and wherein said retention finger has a distal end located in said reduced width passage to overlie a portion of the surface of said pivot shaft to define a positive retention system which prevents removal of said shaft from said channel.

8. The closure system in accordance with claim 7 in which said at least one retention finger is one of two downwardly extending, laterally deflectable, retention fingers that each project from the same one of said two spaced-apart walls;

said body includes two more of said retention fingers projecting from the other of said two spaced-apart walls.

9. The closure system in accordance with claim 1 in which said closure system is a closure for an end of said container wherein the container end defines said container opening; and said closure includes said body and said lid.

10. The closure system in accordance with claim 9 in which said closure is an article that is separate from said container; and said body is attachable to said container end over said container opening.

11. The closure system in accordance with claim 9 in which said closure body is a unitary part of said container and has (1) a peripheral wall that defines said container opening, and (2) an upwardly projecting spout that extends above said container opening to define said at least one orifice.

* * * * *

UNITED STATES PATENT AND TRADEMARK OFFICE

CERTIFICATE OF CORRECTION

PATENT NO. : 7,658,295 B2
APPLICATION NO. : 11/268969
DATED : February 9, 2010
INVENTOR(S) : Hoepner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1081 days.

Signed and Sealed this

Thirtieth Day of November, 2010

David J. Kappos

David J. Kappos
*Director of the United States Patent and Trademark Office*